US007395953B2

(12) United States Patent
Ishizawa et al.

(10) Patent No.: US 7,395,953 B2
(45) Date of Patent: Jul. 8, 2008

(54) FASTENER DRIVING TOOL

(75) Inventors: Yoshinori Ishizawa, Ibaraki (JP); Hiroki Kitagawa, Ibaraki (JP); Masashi Nishida, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/179,516

(22) Filed: Jul. 13, 2005

(65) Prior Publication Data

US 2006/0011692 A1 Jan. 19, 2006

(30) Foreign Application Priority Data

Jul. 14, 2004 (JP) ..... P2004-207940

(51) Int. Cl.
*B25C 1/04* (2006.01)

(52) U.S. Cl. ..... 227/130; 227/120

(58) Field of Classification Search ..... 227/8–10, 227/119–120, 130

See application file for complete search history.

(56) References Cited

U.S. PATENT DOCUMENTS

| | | | | |
|---|---|---|---|---|
| 3,353,737 | A | 11/1967 | Howard et al. | |
| 3,820,705 | A * | 6/1974 | Beals | 227/113 |
| 3,945,551 | A * | 3/1976 | Sato et al. | 227/136 |
| 4,253,598 | A | 3/1981 | Haytayan | |
| 4,401,251 | A * | 8/1983 | Nikolich | 227/130 |
| 5,020,712 | A * | 6/1991 | Monacelli | 227/8 |
| 5,131,579 | A * | 7/1992 | Okushima et al. | 227/130 |
| 5,711,471 | A * | 1/1998 | White | 227/113 |
| 6,641,022 | B2 * | 11/2003 | Hamano et al. | 227/120 |
| 6,779,699 | B2 * | 8/2004 | Aoki et al. | 227/130 |
| 2002/0060233 | A1 | 5/2002 | Akiba | |

FOREIGN PATENT DOCUMENTS

| | | |
|---|---|---|
| EP | 0796703 | 9/1997 |
| EP | 0962288 | 12/1999 |
| EP | 1116556 | 7/2001 |
| EP | 1188522 | 3/2002 |
| JP | 2001-198849 | 7/2001 |

* cited by examiner

*Primary Examiner*—Stephen F. Gerrity
(74) *Attorney, Agent, or Firm*—Mattingly, Stanger, Malur & Brundidge, P.C.

(57) ABSTRACT

A fastener driving tool includes: a driver blade which is driven by compressed air so as to move in a vertical direction for striking a fastener such as a nail, an injection hole which guides said driver blade and forms a passage for the compressed air to be exhausted along with the movement of the driver blade, and a magazine for supplying the fastener to said injection hole, wherein an exhaust passage through which an interior of the injection hole is communicated with the atmosphere is provided between a lower end of the driver blade when the driver blade is positioned at a top dead center and a head part of the fastener which has been supplied into the injection hole.

5 Claims, 7 Drawing Sheets

FASTENER DRIVING TOOL

BACKGROUND OF THE INVENTION

1. Field of the Invention

The present invention relates to a fastener driving tool for driving a fastener such as a nail into an object member by employing compressed air or combustion gas, and more particularly, relates to an art of preventing the fastener from unexpectedly dropping from an injection passage, in the fastener driving tool which is so constructed that the injection passage for injecting the fastener is used also as a passage for exhaust air.

2. Background Art

A first example of a conventional fastener driving tool will be described referring to FIG. 6.

FIG. 6 shows a structure around an injection hole 8 of a fastener driving tool which is driven by compressed air. Other parts than the parts which are shown in FIG. 6 have essentially the same structure as in the fastener driving tool according to an embodiment of the invention as shown in FIGS. 1 to 5.

On a slide face 6*a* of a nose 6 for guiding a driver blade 4, there is formed an exhaust port 7 through which a piston (not shown) is communicated with an injection hole 8 when the driver blade 4 is positioned at a top dead center. After a nail 5 has been driven into an object member (not shown) by means of the driver blade 4 which is provided continuously from the non-shown piston, the compressed air which has been accumulated in a return chamber (not shown) will be supplied to an area below the non-shown piston, and will push the piston upward, thereby to lift the driver blade 4 up to the top dead center, as shown in FIG. 6. On this occasion, the compressed air existing below the non-shown piston is communicated with the injection hole 8 through the exhaust port 7. The compressed air will be discharged to the injection hole 8 through the exhaust port 7, and exhausted to the atmosphere through a gap between the nail 5 and the injection hole 8. At this moment, a stream of the compressed air will push a nail head 5*b* downward.

Meanwhile, a nail feeder 31 pushes the nail 5 toward the injection hole 8 by means of a spring which is not shown. In case where a plurality of the nails 5 are coupled together, the nails 5 except the nail 5*a* which is present inside the injection hole 8 are engaged with a guide groove 11, as shown in FIGS. 1 and 5, whereby downward movements of the nails 5 are restricted. Because the nail 5*a* is coupled to the nails 5, the nail 5*a* will not fall downward, unless it is driven by the driver blade 4.

When only one nail 5 is left, the nail 5*a* inside the injection hole 8 is held by being pushed by the nail feeder 31 so as to be butted against the injection hole 8. Engagement between the nail 5 and the guide groove 11 no longer exists, and holding force of the nail 5*a* will be decreased. It sometimes happens that the stream of the compressed air pushes the nail head 5*b* at this moment, thereby to release the nail 5*a*, and the nail 5*a* drops from the injection hole 8 unexpectedly.

A second example of the conventional fastener driving tool will be described referring to FIG. 7.

FIG. 7 shows a sectional side view of a fastener driving tool 1, as disclosed in Patent Document 1, which is described below, for driving a plurality of nails 5 which are coupled together by means of a plastic sheet. The fastener driving tool 1 is provided with a sheet discharge port 27 for discharging the plastic sheet to the exterior, at a side of supplying the nails 5 in the injection hole 8. The sheet discharge port 27 is provided at a position closer to the injection hole 8 than the nail head 5*b*. During driving operation of the nail 5, a part of surplus compressed air, after the piston 3 has returned to the top dead center, will be exhausted from this sheet discharge port 27 to the exterior.

[Patent Document 1]

Japanese Patent Publication No. JP-A-2001-198849 (Application No. 2000-14766)

In either of the above described structures, it has sometimes happened that the stream of the compressed air pushes the nail 5*a* downward, and the nail 5*a* unexpectedly drops from the injection hole 8, because the holding force is decreased when only one nail 5 is left.

SUMMARY OF THE INVENTION

An object of the invention is to provide a fastener driving tool in which unexpected drop of a fastener such as a nail from an injection hole can be prevented.

In a fastener driving tool including a driver blade which is driven by compressed air so as to move in a vertical direction for striking a fastener such as a nail, an injection hole which guides the driver blade and forms a passage for the compressed air to be exhausted along with the movement of the driver blade, and a magazine for supplying the fastener to the injection hole, an exhaust passage through which an interior of the injection hole is communicated with the atmosphere is provided between a lower end of the driverblade when the driver blade is positioned at a top dead center and a head part of the fastener which has been supplied into the injection hole. By providing the exhaust passage, the compressed air which is exhausted along with the movement of the driver blade will enter into the injection hole, and will be exhausted through the exhaust passage, before the fastener is pushed downward. As the results, it is possible to prevent unexpected drop of the fastener from the injection hole, even in a state where the holding force of the fastener has been weakened.

Further, it is desirable that a cover for covering the exhaust passage is provided at a position opposed to a side of the exhaust passage communicated with the atmosphere, keeping a gap with respect to the exhaust passage. By providing this cover, the air from the exhaust passage will be discharged to the exterior through the gap between the cover and the exhaust passage. As the results, it is possible to prevent ambient dust from swirling or to prevent an attack of air stream against an operator.

According to the structure in a first aspect of the invention, because the compressed air which is exhausted along with the movement of the driver blade will enter into the injection hole, and will be exhausted through the exhaust passage, before the fastener is pushed downward, it is possible to prevent unexpected drop of the fastener from the injection hole, even in a state where the holding force of the fastener has been weakened. Therefore, it is possible to provide the fastener driving tool in which the fastener will not unexpectedly drop from the injection hole.

According to the structure in a second aspect of the invention, because the air from the exhaust passage will be discharged to the exterior through the gap between the cover and the exhaust passage, it is possible to prevent ambient dust from swirling or to prevent an attack of the air stream against an operator. Therefore, it is possible to provide the fastener driving tool in which the fastener will not unexpectedly drop from the injection hole, and which has excellent workability.

BRIEF DESCRIPTION OF THE DRAWINGS

The present invention may be more readily described with reference to the accompanying drawings.

DETAILED DESCRIPTION OF THE PREFERRED EMBODIMENTS

Now, a fastener driving tool according to an embodiment of the invention will be described referring to FIGS. 1 to 6.

Figure 1:
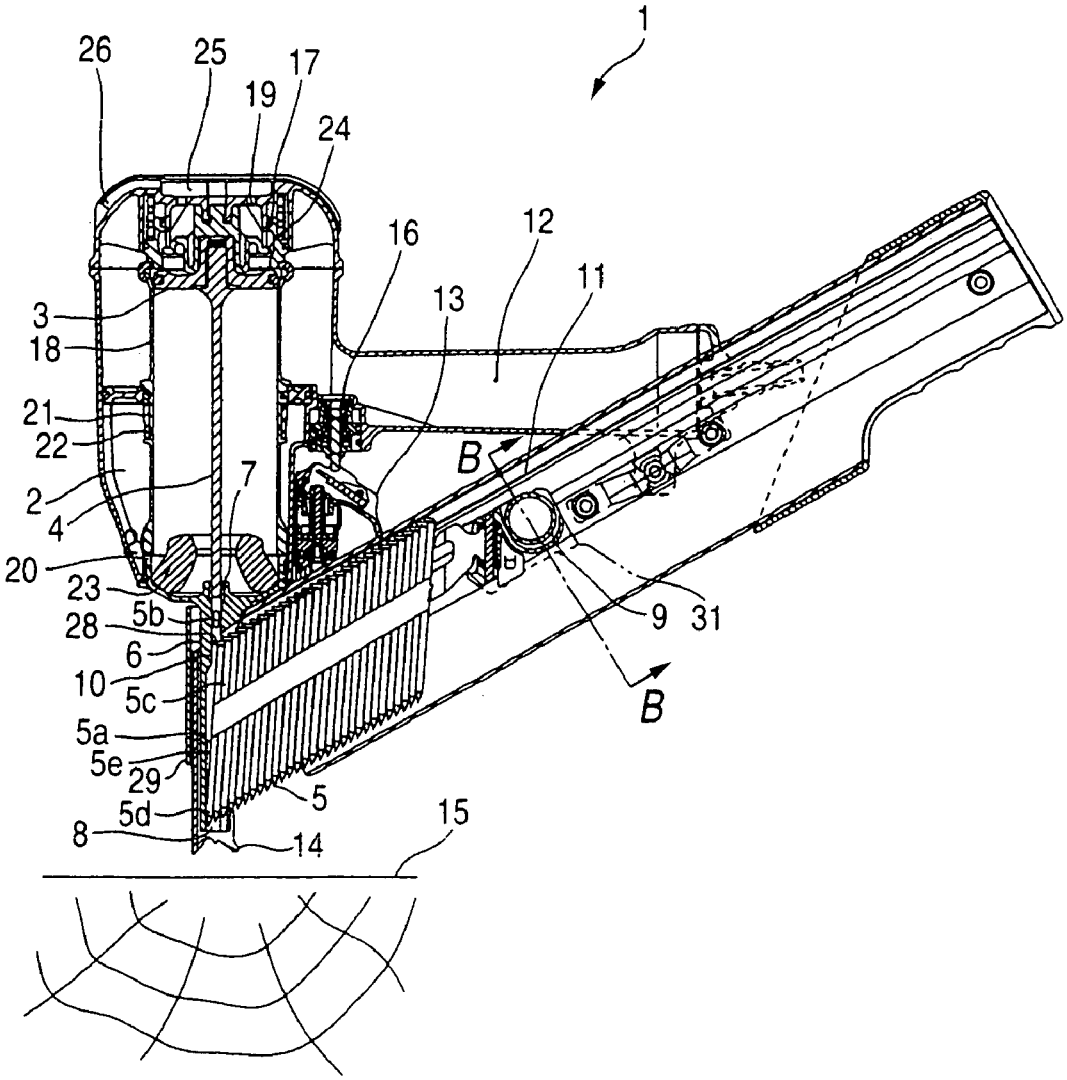
FIG. 1 is a sectional view showing an overall structure of a fastener driving tool according to an embodiment of the invention.

FIG. 1 shows the fastener driving tool in a state where compressed air is accumulated by connecting an air hose, which is not shown, to a main body of a fastener driving tool 1. The compressed air is accumulated in an accumulator 12.

When a trigger valve 16 is put into an ON position, by conducting both operations of pulling a trigger 13 and butting a push lever 14 against a lumber 15, a main valve 17 will move to a top dead center, and the accumulator 12 will be communicated with a space above a piston 3 in a cylinder 18. Moreover, communication between the accumulator 12 and an air passage 19 will be shut off. Owing to the compressed air which has flowed from the accumulator 12 into the space above the piston 3 inside the cylinder 18, the piston 3 will drive a nail 5 into the lumber 15 while the piston 3 abruptly moves toward a bottom dead center. An air existing below the piston 3 inside the cylinder 18 will flow into a return chamber 2 through an air passage 20. When the piston 3 has passed by an air passage 22 provided with a check valve 21, a part of the compressed air above the piston 3 will flow into the return chamber 2 through the air passage 22. The piston 3 will be brought into contact with a piston bumper 23 at the bottom dead center, and deformed, whereby surplus energy will be absorbed.

When the trigger valve 16 has been put into OFF position by returning the trigger 13 or stopping the butting operation of the push lever 14 against the lumber 15, the main valve 17 will move to the bottom dead center. Then, the main valve 17 will be closed, and communication between the accumulator 12 and the space above the piston 3 inside the cylinder 18 will be shut off, whereby the space above the piston 3 inside the cylinder 18 will be communicated with the atmosphere by way of an exhaust valve rubber 24. A lower part of the piston 3 will be pressed with the compressed air which has been accumulated in the return chamber 2, and the piston 3 will abruptly move to the top dead center. The compressed air above the piston 3 will be exhausted to the atmosphere from an exhaust port 26 by way of the air passage 19 and an expansion chamber 25, and the piston 3 will be returned to the original position.

After the piston 3 has been returned to the top dead center by the compressed air which has been accumulated in the return chamber 2, the surplus compressed air will flow into the injection hole 8 from an exhaust port 7 which is formed on a slide face 6*a* of a nose 6 for guiding the driver blade 4 and the nail 5. The driver blade 4 slides along the slide face 6*a*. The compressed air which has been exhausted will be discharged to the exterior through an air passage 28 according to the invention. Particulars of the exhaust passage 28 will be described below.

Figure 2:
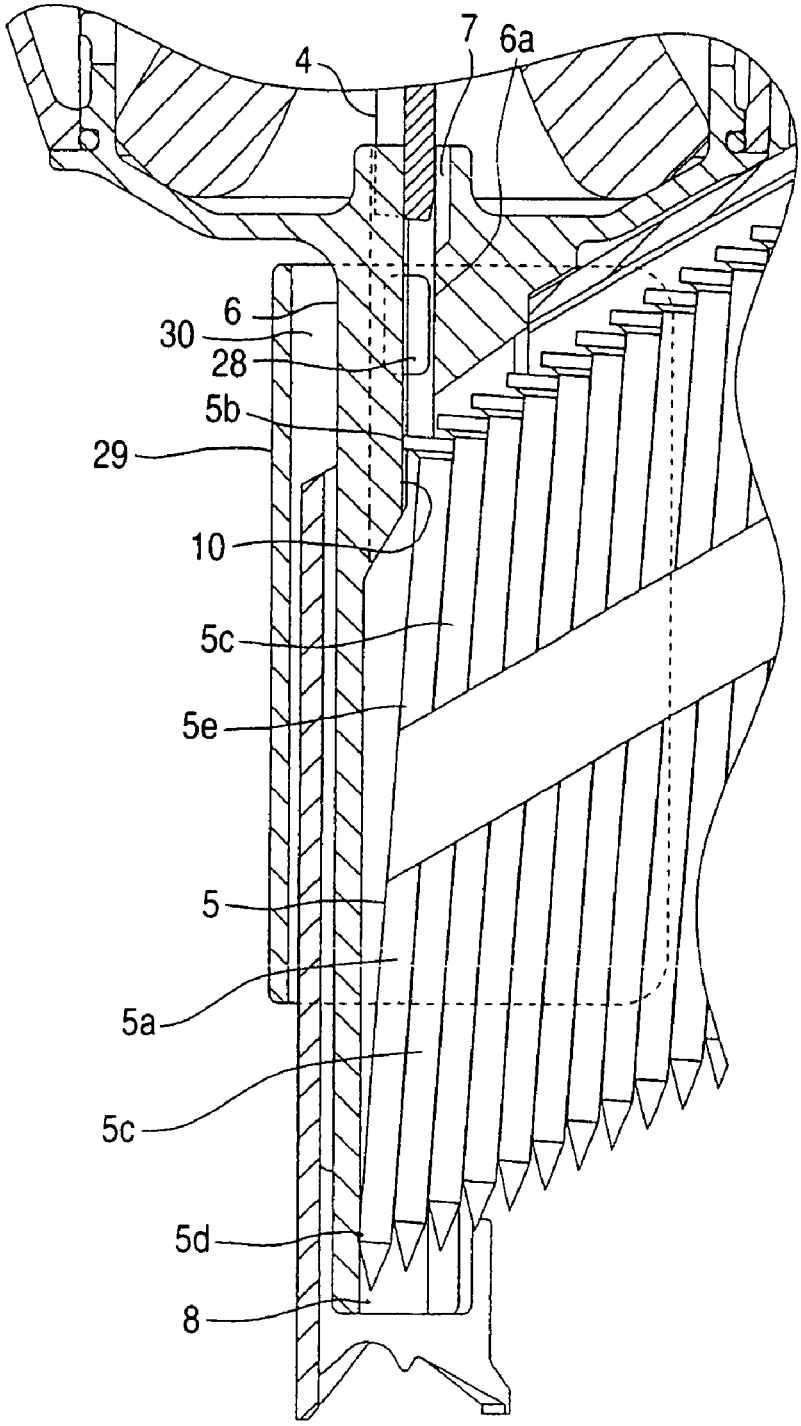
FIG. 2 is a sectional view of an essential part of the fastener driving tool in FIG. 1, in a state where a plurality of nails are contained.
Figure 3:
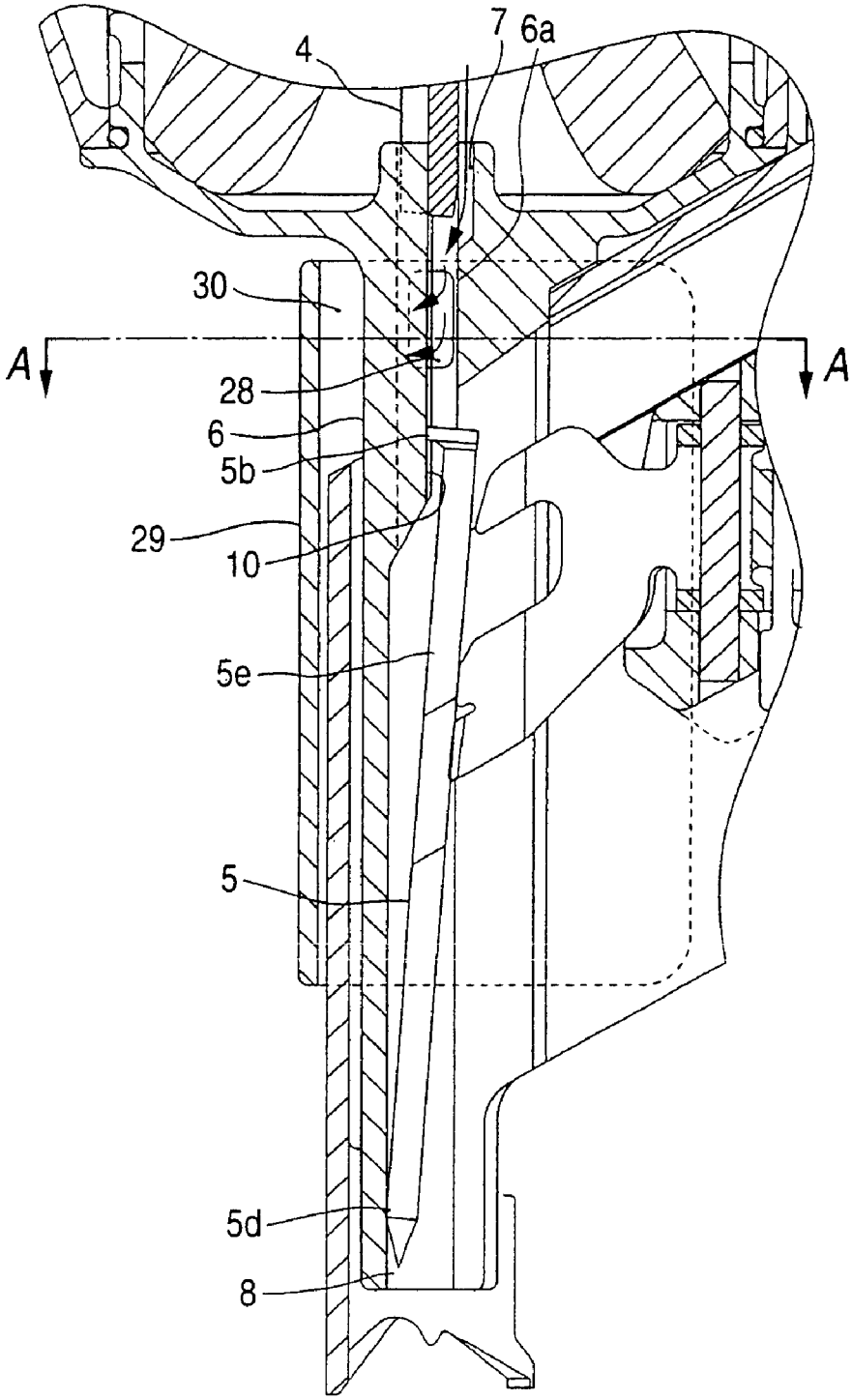
FIG. 3 is a sectional view of the essential part of the fastener driving tool in FIG. 1, in a state where only one nail is contained.
Figure 5:
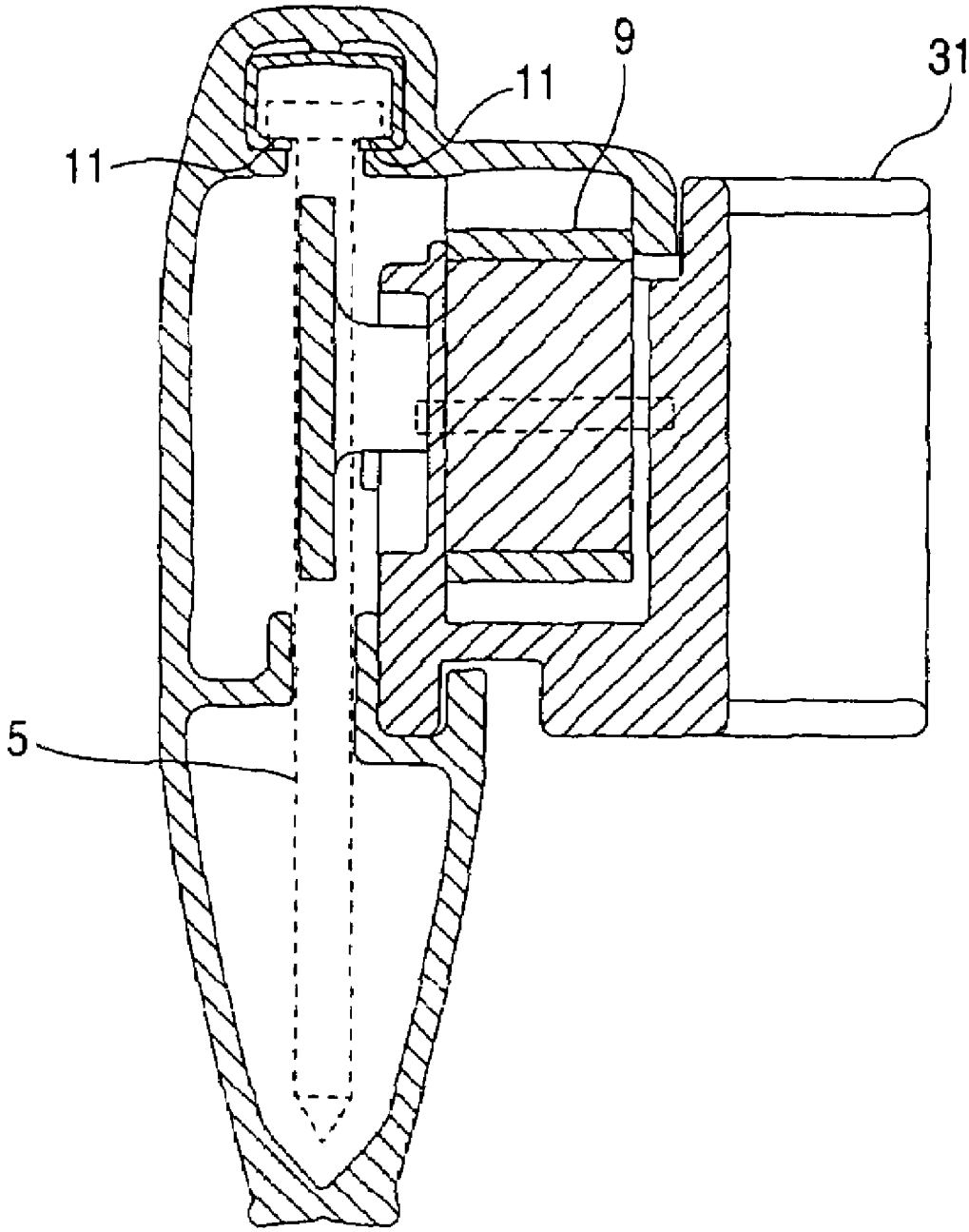
FIG. 5 is a sectional view taken along a line B-B in FIG. 1.
Figure 6:
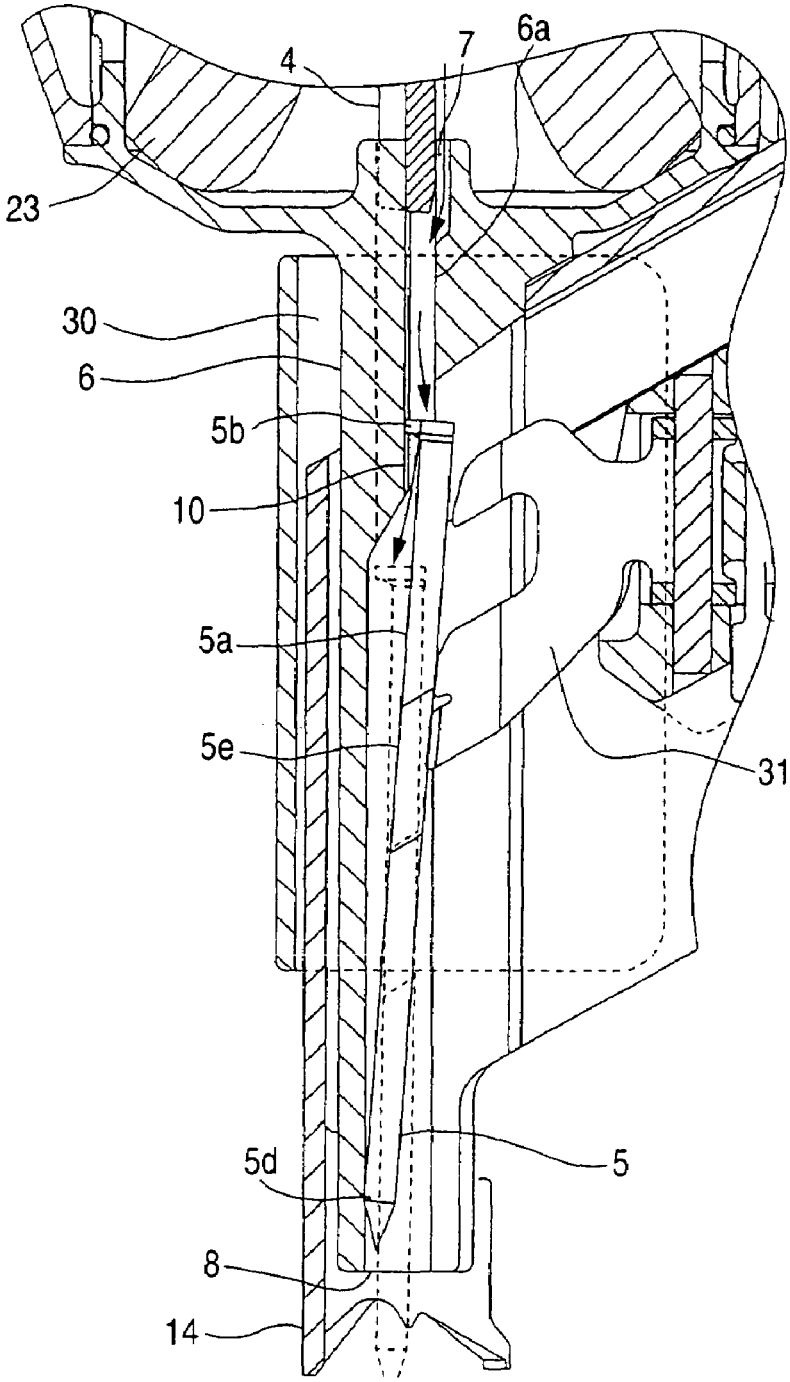
PRIOR ART FIG. 6
FIG. 6 is a sectional view of an essential part of a conventional fastener driving tool, in a state where only one nail is contained.
Figure 7:
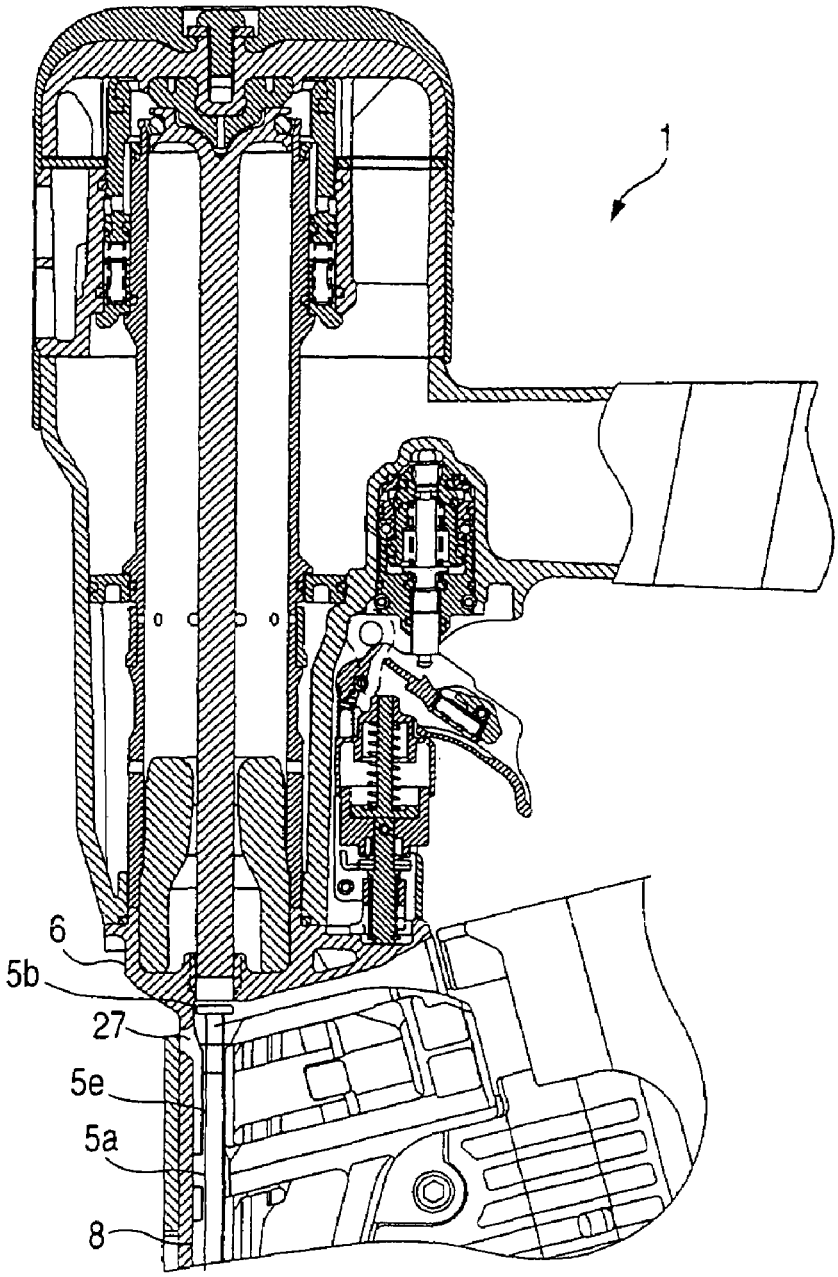
PRIOR ART FIG. 7
FIG. 7 is a sectional view showing a structure of a fastener driving tool which is disclosed in Patent Document 1.

Meanwhile, the nail feeder 31 pushes the nail 5 toward the injection hole 8 by means of a spring 9. In case where a plurality of the nails 5 are coupled together as shown in FIG. 2, the nails 5 are held in a direction to the injection hole 8, by contacting the nail head 5*b* of the first nail 5*a* with a projected part 10 which is formed at a position opposed to a supplying direction of the nail 5 in the injection hole 8 so that a second nail Sc may not protrude into the injection hole 8, and by contacting a nail leg end 5*d* with the injection hole 8. Other nails 5 are in contact with the nail feeder 31, and further, the nail heads of the other nails 5 are engaged with a guide groove 11, as shown in FIG. 5. Because the nail heads 5*b* of the other nails 5 are engaged with the guide groove 11, and the nail 5*a* is coupled to the nails 5, downward movement of the nail 5*a* is restricted. The nail 5*a* will not drop from the injection hole 8, unless it is driven by the driver blade 4. As shown in FIG. 3, when only one nail 5 is left, the nail 5 will be held by contacting the nail head 5*b* with the projected part 10, by contacting the nail leg end 5*d* with the injection hole 8, and by contacting a nail shaft 5*e* with the nail feeder 31. On this occasion, the engagement between the nail head 5*b* and the guide groove 11 no longer exists, and so, holding force of the nail 5 has been weakened.

According to the invention, the air passage 28 for communicating the injection hole 8 with the exterior is provided at a position between the exhaust hole 7 and a nail loading position of the nose 6, where an interference with the projected part 10 may not occur. In other words, the air passage 28 for communicating the injection hole 8 with the exterior is provided between a lower end of the driver blade 4 when the driver blade 4 is positioned at the top dead center and a backward end of the nail 5 which has been fed into the injection hole 8, that is, the nail head 5*b*. It is to be noted that in this embodiment, the nail head 5*b* corresponds to a head part of a fastener.

According to this structure, the compressed air flows into the injection hole 8 through the exhaust port 7, as shown by an arrow mark in FIG. 3. Although a part of the compressed air which has flowed in will flow along the nail 5 too, almost all part of the compressed air will be discharged to the exterior through the exhaust passage 28 which is provided between the exhaust port 7 and the loading position of the nail 5. In other words, the compressed air to be exhausted along with the movement of the driver blade 4 will enter into the injection hole 8, and will be discharged through the exhaust passage 28 before the nail 5 is pushed downward. As the results, it is possible to prevent unexpected drop of the nail 5 from the injection hole 8, even in a state where the holding force of the nail 5 has been weakened.

Figure 4:
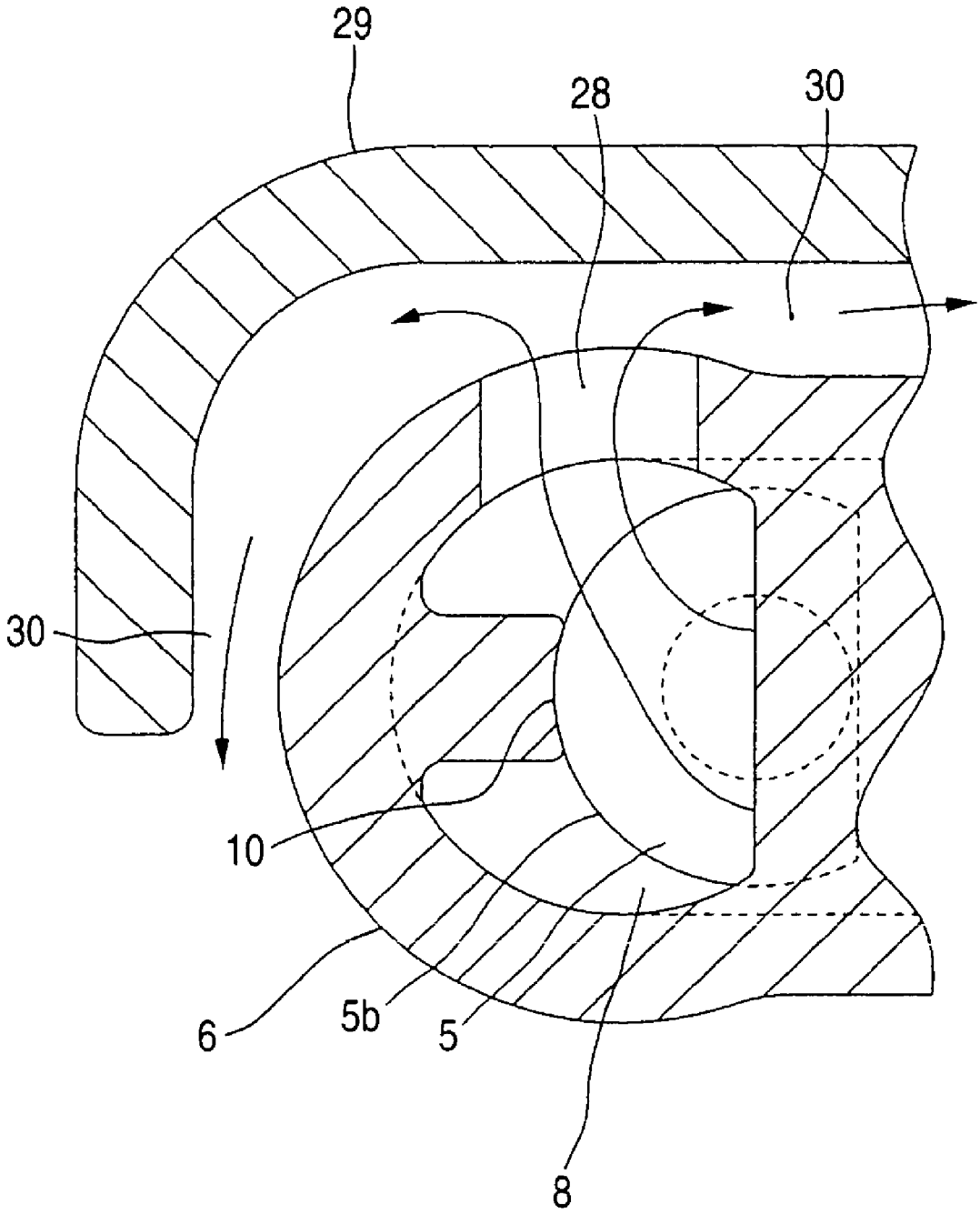
FIG. 4 is a sectional view taken along a line A-A in FIG. 3.

Additionally, according to the invention, a cover 29 which covers the exhaust passage 28 is provided at a position opposed to a side of the exhaust passage 28 communicated with the atmosphere, keeping a gap 3O with respect to the exhaust passage, as shown in FIGS. 3 and 4. The cover 29 is provided continuously from the nose 6 so as to cover a part of the nose 6.

According to this structure, the compressed air exhausted from the exhaust passage 28 will be blocked by the cover 29, and will be exhausted after the speed has been reduced, because the compressed air is diffused from the gap 30 between the inner periphery of the cover 29 and the nose 6, as shown by an arrow mark in FIG. 4. In this manner, it is possible to prevent ambient dust from swirling or to prevent an attack of air stream against an operator.

What is claimed is:

1. A fastener driving tool comprising:

a driver blade which is driven by compressed air so as to move in a vertical direction between top dead center and bottom dead center for striking a fastener, an injection hole which guides said driver blade and forms a passage for the compressed air to be exhausted along with a movement of the driver blade, a magazine for supplying the fastener to said injection hole, an exhaust passage through which an interior of the injection hole is communicated with an atmosphere, said exhaust passage being located between a lower end of the driver blade when the driver blade is positioned at a top dead center and a head part of the fastener which has been supplied into the injection hole, and a cover for covering said exhaust passage provided at a position opposed to a side of the exhaust passage communicated with the atmosphere, keeping a gap with respect to the exhaust passage.

2. A fastener driving tool comprising:

a driver blade which is driven by compressed air so as to move in a vertical direction between a top dead center and a bottom dead center for striking a fastener;

a nose portion having an injection hole extending vertically to guide the driver blade and to form a passage for the compressed air to be exhausted along with a movement of the driver blade, said nose portion having a protrusion projecting into the injection hole to contact a head part of a leading fastener which is supplied into the injection hole, and a magazine for supplying the fastener to said injection hole, wherein said nose portion is provided with an exhaust passage through which an interior of the injection hole is communicated with an atmosphere, said exhaust passage being located at a position adjacent to the protrusion and between a lower end of the driver blade when the driver blade is at the top dead center and the head part of the leading fastener to exhaust the compressed air which is injected into the injection hole, wherein a cover for covering said exhaust passage is provided at a position opposed to a side of the exhaust passage communicated with the atmosphere, keeping a gap with respect to the exhaust passage.

3. A fastener driving tool as claimed in claim 2, wherein the compressed air to be exhausted along with movement of the driver blade will enter the injection hole, and will be discharged through the exhaust passage before the fastener is pushed downward, thereby preventing an unexpected drop of the fastener from the injection hole even when a holding force of the fastener has weakened.

4. A fastener driving tool as defined in claim 2, which further comprises:

a housing;

a cylinder disposed in the housing;

and a piston slidably disposed in the housing;

and wherein the driver blade is connected with the pistons.

5. A fastener driving tool as claimed in claim 2, wherein the fastener is held by contacting the head of the fastener with said protrusion which projects into the injection hole, by contacting a leg of the fastener with the interior of the injection hole, and by contacting a shaft of the fastener with a feeder for the fastener.

* * * * *